United States Patent [19]

Janssen

[11] 4,428,091

[45] Jan. 31, 1984

[54] TOOTHBRUSH

[76] Inventor: Thomas B. Janssen, 153 Waverly Pl., New York, N.Y. 10014

[21] Appl. No.: 330,168

[22] Filed: Dec. 14, 1981

[51] Int. Cl.[3] ..... A46B 13/08

[52] U.S. Cl. ..... 15/167 A; 15/172; 15/244 C

[58] Field of Search ..... 15/167 A, 167 R, 172, 15/176, 244 A, 244 R, 244 C

[56] References Cited

U.S. PATENT DOCUMENTS

| | | | |
|---|---|---|---|
| 1,911,973 | 5/1933 | Ruse | 15/167 A |
| 2,284,200 | 5/1942 | Gruss | 15/167 A |
| 3,769,652 | 11/1973 | Rainer | 15/167 A |
| 3,886,618 | 6/1975 | Paoletti | 15/172 |
| 4,366,592 | 1/1983 | Bromboz | 15/167 A |

*Primary Examiner*—Harvey C. Hornsby
*Assistant Examiner*—Michael Knick
*Attorney, Agent, or Firm*—Mandeville and Schweitzer

[57] ABSTRACT

The disclosure is directed to a novel and improved toothbrush construction which provides not only effective brushing action on the teeth, but also imparts a gentle yet highly effective massaging action to the gums as well as the dental underpinnings. The brushing head assembly of the new device is arranged for either rotary or nonrotary operation and includes a pair of opposed, generally circular flange-forming members, formed of a soft, closed cell foam material, and central, generally lense-shaped portions of a material of substantially less resilience. These flange-forming members are separated by a central impact cushion, somewhat disc-like in shape and formed of soft foam material. The entire assembly is held under axial compression by a pair of opposed cup-like restrainig hubs. When the user exerts a biting or chewing action on the central impact cushion, a unique cooperative action between the lense-shaped sides of the flange-forming members and the cup-like retaining hubs causes an umbrella-like collapse of the flange-forming members. As a result, the working surfaces (i.e., bristles for the teeth, other projections for the gums) are brought to bear on the dental structures.

17 Claims, 7 Drawing Figures

FIG.1
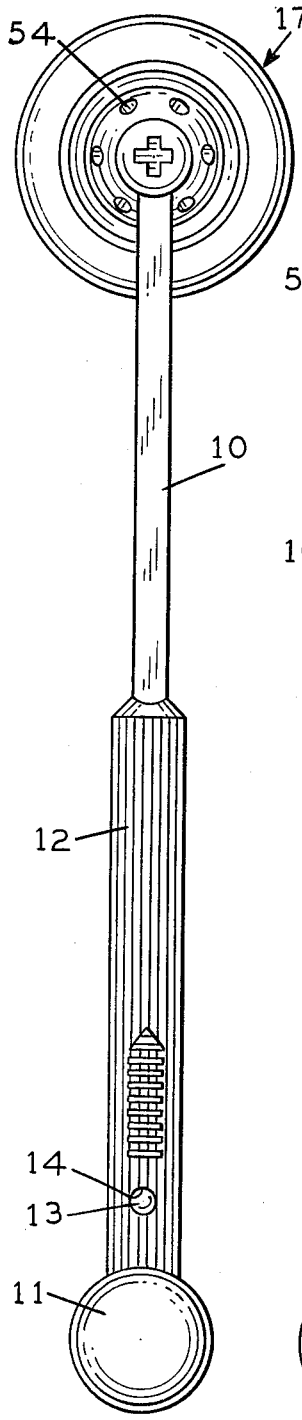
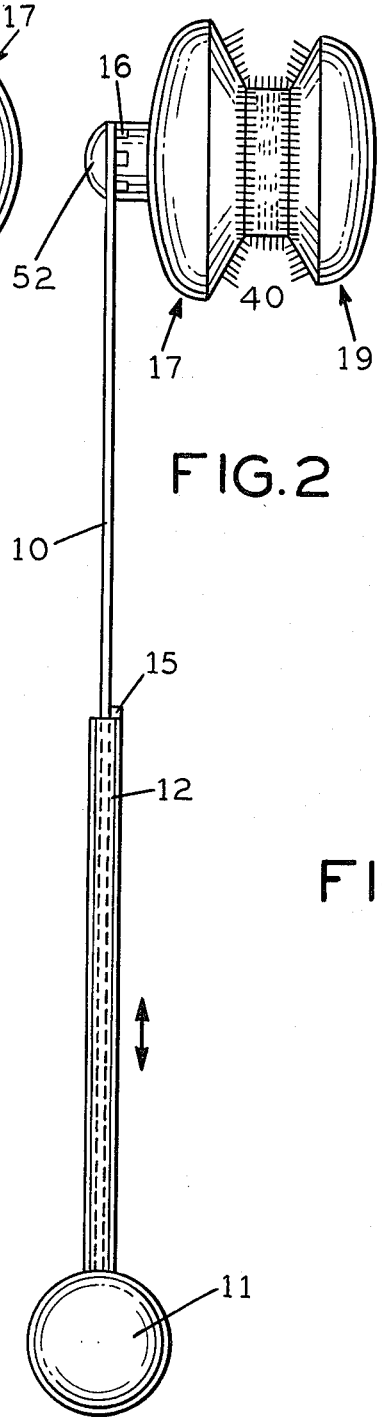
FIG.2
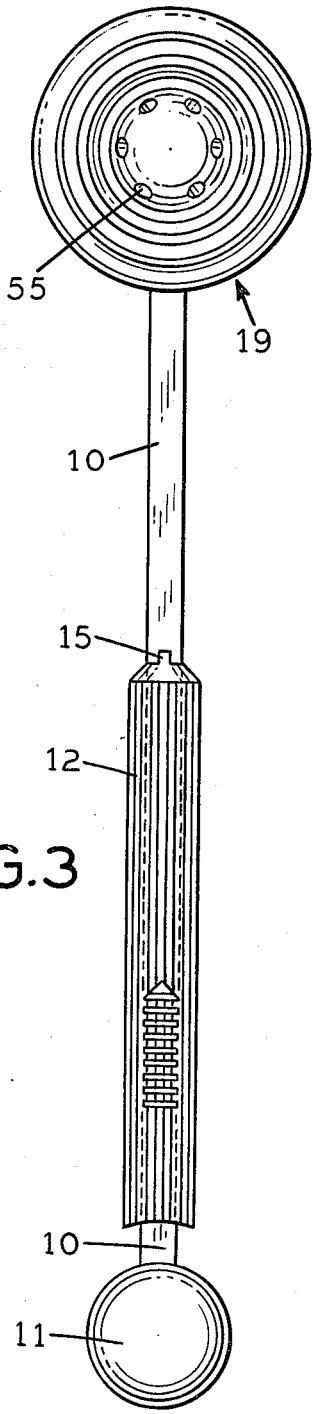
FIG.3

TOOTHBRUSH

BACKGROUND AND SUMMARY OF THE INVENTION

Over a period of time, functional inadequacies of the common toothbrush conspire with human frailties to induce a "decay bias" in which various dental tissues or structures begin to exhibit disproportionate hygienic neglect. For example, a slighting of the lingual surfaces and back teeth is often observed. Another common bias is associated with right- or left-handedness wherein one quadrant of the jaw or another manifests relative neglect.

In an attempt to get more uniform and effective results, numerous alternatives have been devised to replace the familiar toothbrush with little or no apparent success.

In general, a toothbrush should help in a convenient and pleasurable way to maintain the health and integrity of the entire dental "ecosystem"; the teeth as well as the gums and dental underpinnings. In devising an implement for treating the dental structures, one must be ever mindful of differences as to size, shape, buccal versus lingual topography, and displacement of the teeth within the dental arch. It has been clinically demonstrated that lateral surfaces of the teeth should be scrubbed parallel with the grain; chewing surfaces, following the arch. Sub-gingival surfaces, on the other hand, require a sweeping or oscillating approach that fairly traces the scalloped gum line. Here, great care must be exercised lest the gums be pushed back, pried or otherwise torn from their cervical attachments.

Different means should be used to treat the supporting structures. The gums must be pampered, not abused by bristles or similar abrasive elements and the like. As with other periodontal tissues (peridental membrane, cementum and alveolar bone) the object here is to maintain a moving and plentiful supply of blood through gentle massage and stimulating exercise at regular intervals.

A rather wide variety of devices has been proposed in the past for simplifying and making more effective brushing operations, and achieving a measure of stimulation of the gum tissue. Typically, however, prior proposals have inadequately treated the entire dental system, favoring molars over incisors, for example, or treating the gums while slighting the teeth or vice versa.

In accordance with the present invention, a novel and improved toothbrush construction is provided which addresses the entire complex structure and topography of the dental system and enables the effective cleaing of all of the teeth (incisors, canine and molars), while also providing for a gentle yet effective massage and stimulation of the periodontium, consistent with maintaining a rich supply of blood to these tissues.

In one of its primary use modes, the toothbrush of the invention is activated by chewing or biting motions. In this connection, the prior art has received many proposals for toothbrushes or gum massage devices activated by chewing motions. None, however, have been effective in treating the entire dental environment and most have been extremely limited in function. Pursuant to the present invention, a brushing head is provided, which comprises a central impact cushion, enclosed between a pair of opposed, side flange members of somewhat semi-spherical shape and of larger diameter than the impact cushion. Both the impact cushion and the side flanges are formed of a soft spongy material, and between them are relatively non-resilient lense-shaped displacement wafers arranged, when the impact cushion is compressed by biting or chewing action, to be displaced axially outward against their respective side flange members. The side flange members are in turn confined by cup-shaped restraining hubs, which accommodate axial displacement of the center portions of the side flange members, but not the outer portions. This results in a unique downward and inward stroking action of the outer portions of the side flange members, when displaced by chewing action. The size and configuration of the side flange members is such that portions thereof, containing bristles, are adjacent the teeth surfaces, and other portions thereof are adjacent the gingival tissues at the base of the teeth. The arrangement is such that, when compressed by chewing action, the side flange members simultaneously engage the teeth with bristled areas and gently massage the adjacent gum areas with a massaging action in a generally vertical direction. A uniquely advantageous and satisfactory brushing and massaging action results.

In accordance with one aspect of the invention, the juncture between the central impact cushion element and the side flange elements is maintained by pressure alone, without bonding. As a result, the incisors, canines, and to some extent, the premolars, can be partially received between the impact cushion and side flange members during chewing and biting of the brush head, to assure effective cleaning and massage in these areas. This is typically overlooked in prior art proposals for brushing devices activated by chewing.

In accordance with another aspect of the invention, the brushing head is adapted for either rotary or fixed operation, having a simple, manually actuated control element which either locks the head against rotation or frees it to turn. For rotary brushing operation, the brushing head is positioned with the side flange members straddling the teeth, and the head is rolled along the teeth to impart a brushing and sweeping action.

The brushing device of the invention achieves the above and other dentally significant objectives while at the same time being easy and convenient and attractive to use and relatively simple and inexpensive to manufacture.

For a more complete understanding of the above and other features and advantages of the invention, reference should be made to the following detailed description of a preferred embodiment and to the accompanying drawings.

DESCRIPTION OF THE DRAWINGS

FIGS. 1 and 2 are back and side elevational views of a toothbrush device incorporating various features of the invention.

FIG. 3 is a front elevational view of the device of FIGS. 1 and 2, showing a manual locking element in a displaced position.

DESCRIPTION OF THE PREFERRED EMBODIMENT OF THE INVENTION

Figure 4:
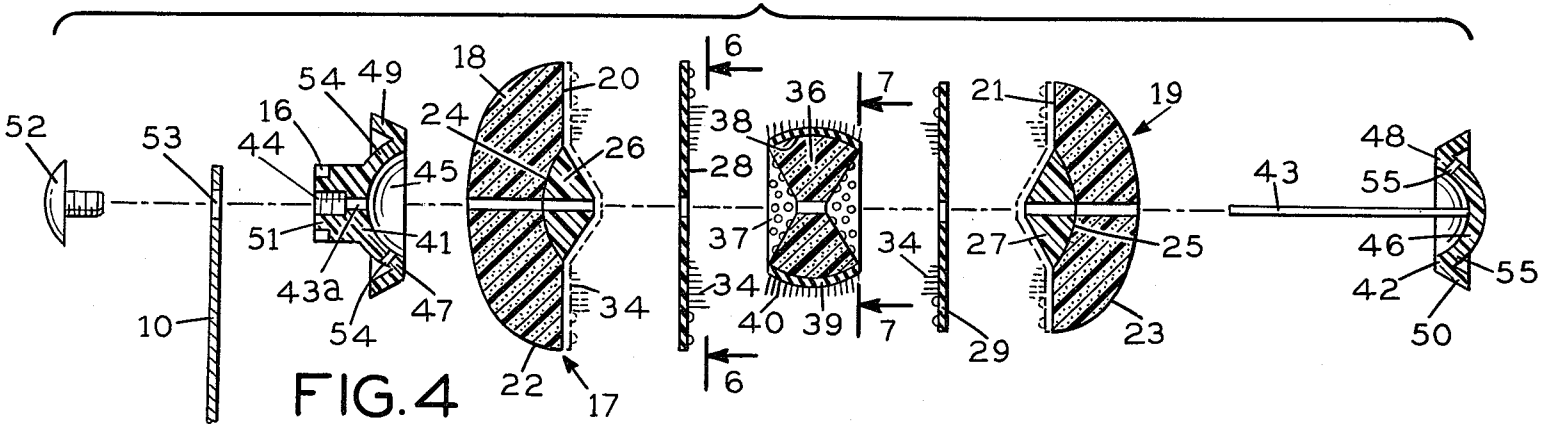
FIG. 4 is an exploded cross sectional view showing details of construction of the brushing head of the device of FIGS. 1–3.

Referring now to the drawing, the reference numeral 10 designates a thin, flat, stem-like handle member, which typically may be in the form of an elongated, semi-flexible stainless steel, for example. At its lower end, the handle is provided with a spherical enlargement for convenience in gripping. A tubular gripping section 12 is received slidably over the handle 10 and is normally positioned at the lower end of the handle, as shown in FIGS. 1 and 2, by means of a small detent bump 13, provided on the stem handle 10, which projects into an opening 14 provided on the tubular gripping element. At its upper end, the slidable gripping element is povided with a locking or strike tab 15, which is receivable in recesses 16 provided in a normally rotatable brushing head 17 (to be described) to lock the brushing head against rotation. The brushing head is locked by releasing the gripping element 12 from its detented position at the bottom of the stem handle 10 and sliding upwardly until the strike tab 15 is inserted in one of the recesses 16. The gripping element 12 may be held manually or by detent means (not shown) in its upper or locking position.

Pursuant to important aspects of the invention, the brushing head 17, shown in detail in FIGS. 4–7, includes a variety of novel and advantageous features which combine to provide a dental device which is greatly superior to prior devices. The brushing head advantageously is in the form of a body of revolution, capable of being utilized in either a rotary or nonrotary mode of operation. As reflected in the exploded view of FIG. 4, the brushing head includes a pair of flange-forming side members 18, 19 formed of a soft, spongy closed-cell foam material. The flange-forming members are of circular cross section, generally flat along their inside or facing surfaces 20, 21 and preferably rounded on their respective outer surfaces 22, 23. Each side flange member 18, 19 is provided with a central concave recess 24, 25 for the reception, respectively, of lense-like displacement wafers 26, 27. To advantage, the displacement wafers are bonded to the flange-forming members in the area of the inner face along the recesses 24, 25.

Each of the flange-forming side members 18, 19 has bonded to its inner surface a thin membrane 28, 29. The membrane may be a relatively soft resilient material, such as natural rubber, which is able to conform readily to the compound inner surface contours of the flange-forming members 18, 19 and the displacement wafers 26, 27 bonded thereto.

Figure 6:
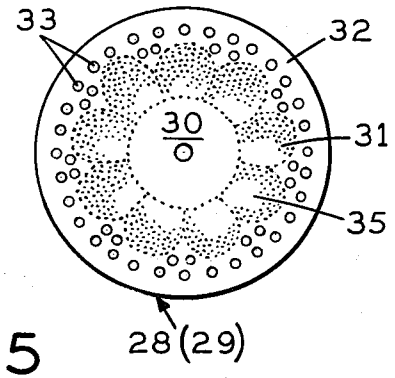

An elevational view of the inside surfaces of the membranes 28, 29 is shown in FIG. 6. In the illustrated form of membrane, three radial zones are delineated, an inner zone 30, a medial zone 31 and an outer zone 32. In the outer zone 32, the membrane is provided with a plurality of surface bumps or projections 33. These, as will be more fully explained, are arranged to bear against the gum tissue to provide an enhanced massaging, stimulating action. In the medial zone 31, the membrane mounts short bristles 34. Ideally, the bristles 34 are of progressively increasing length toward the radially outer portions of the zones 31, the longer bristles being designed to probe the subgingival areas. To advantage, the bristle-carrying medial zone 31 is constructed so that the bristle-carrying areas are of a somewhat scalloped configuration, with an odd number of lobes 35. The width of the lobe areas 35 is calculated to have a general correspondence with typical dental structure, and the provision for an odd number of lobes takes into consideration the fact that there is a generally staggered relationship between the upper and lower teeth. Furthermore, this zone, by intention, only partially corresponds to the vertical-longitudinal surfaces of the teeth. Said partial correspondence calculates and limits the extent to which the gum line might otherwise be repulsed in chewing use of the implement.

Figure 5:
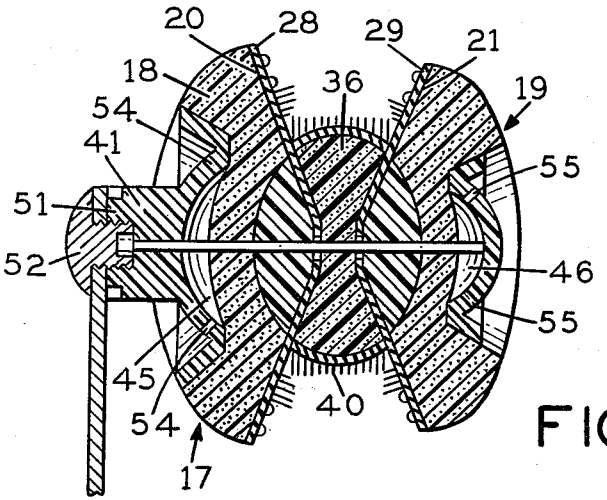
FIG. 5 is a cross sectional view of the assembled brushing head.

As will be noted particularly in FIGS. 4 and 5, the flange-forming side member 19 is somewhat smaller in diameter than the opposing member 18, and this is to accommodate the slightly different topography on the lingual and buccal sides. In this connection, of course, the sizing of the respective membranes 28, 29 is made to correspond with the flange-forming members on which they are mounted.

Positioned between the flange-forming side members is an impact cushion 36 which, like the side members 18, 19, is formed of a soft, spongy closed cell foam material. The impact cushion 36, as shown particularly in FIG. 4, is in the form of a disc with opposing concave end surfaces 37, the contours of which conform in a general way to the inwardly facing contours of the respective displacement wafers 26, 27.

Bonded to the outer circumferential surface 37 of the impact cushion 38 is an annular membrane 39, which desirably is bonded in position. The membrane 39 mounts bristles 40 over generally its entire outer surface and, in the illustrated arrangement, the bristles are of varying length from side to side of the impact cushion so that the outer ends of the bristles are on a more or less uniform distance from the center axis of the element.

Figure 7:
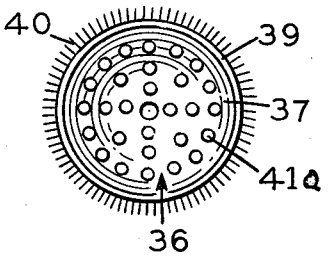
FIGS. 6 and 7 are sectional views taken on lines 6—6 and 7—7 respectively of FIG. 4.

As reflected in FIGS. 4 and 7, the concave side wall surfaces 37 of the impact cushion desirably are provided with a plurality of bumps or protrusions **41*a***, which may be derived from a bonded membrane, for example, or, more preferably, by being formed integrally on the outer skin of the soft foam material.

Positioned on the outsides of the flange-forming side members 18, 19 are a pair of cup-like restraining hubs 41, 42, which are formed of a relatively non-resilient, molded plastic material. An axle 43, which may be integral with one of the restraining hubs 42, extends through center openings in each of the brush head components previously described and into a recess **43*a* in the other hub. In the assembly of the brushing head, the restraining hubs are pressed together, with the soft foam parts between them, compressing the foam as necessary to enable the axle rod 43 to extend into the recess 43*a*. The end of the rod is then deformed by heat or solvent, so that the opposed restraining hubs are fixed in a predetermined spaced relationship, substantially as indicated in FIG. 5**, with the soft foam elements compressed between.

As shown particularly in FIG. 5, the compression assembly of the brush head elements serves to rather tightly squeeze the central portions of the flange-forming members 18, 19. The respective restraining hubs 41, 42 are of smaller diameter than the respective flange-forming members 18, 19 such that the outer peripheral portions of the flange-forming members are permitted to remain in a relatively less compressed condition. This distorts the shape of the flange-forming member, such that the inwardly facing sidewalls 20, 21 thereof and the respective membranes 28, 29 bonded thereto, assume an outwardly divergent configuration, with the impact cushion 36 axially compressed between them, leaving an annular recess of somewhat "W" shaped cross section.

Desirably, the restraining hubs are designed to have concave, cup-like central sections 45, 46 of much shorter radius of curvature than that of the external surfaces 22, 23 of the side forming members. The outer edges of these cup-like recesses are defined by annular compression surfaces 47, 48 joined with outwardly extending frustoconical flanges 49, 50. As is reflected in FIG. 1, the diameter of the compression surfaces 47, 48 is approximately that of the respective displacement wafers 26, 27, being somewhat smaller for the lingual side than the buccal side. When the restraining hubs are brought into a compression relationship with the assembled foam components, the central portions of the side forming members 18, 19 compress and bulge partly but not entirely into the cup-like recesses 45, 46. If desired, the compression surfaces 47, 48 may be textured to provide better purchase on their respective side flange elements.

The buccal-side hub 41 has a hub extension 51 which is adapted to receive a mounting screw 52. The screw 52 is arranged to be received in an opening 53 in the stem handle 10 and then be threadedly received in the recess 44 of extension 51, providing for the rotatable mounting of the entire brush head assembly on the handle. The hub extension 51 is provided with a series of circumferentially spaced notches 16, previously described, for optional engagement with a stop tab 15 to provide for nonrotational securement of the brushing head when desired.

Desirably, the cup-shaped portions 45, 46 of the retaining hubs are provided with a plurality of through openings 54, 55 for ventilation and draining of the cavity between the cup and the flange-forming members 18, 19.

In the use of the brushing device of the invention, it is recommended that the brushing head be in a rotary mode for the initial brushing phase. The head is inserted into the mouth, and the impact cushion 36 pushed either upwardly or downwardly against the teeth and drawn along the dental arch, providing a lateral sweeping movement of the bristles 34 and projections 33 along the sides of the teeth and gums. The radially disposed bristles 40, around the central impact cushion 36, serve to clean the end surfaces of the teeth, particularly the molars; said bristles also provide traction in rotational use.

Significantly, the relationship of the flange-forming side members 18, 19 with the central impact cushion 36 is such that the narrower teeth, the incisors, canines and premolars can displace the impact cushion laterally sufficiently to separate the parts and allow these more wedge-shaped teeth to enter between the flange-forming element and the impact cushion. The channel formed by the side members and impact cushion is of "W" or double "V" shape, forming two sub-channels. The fact that there are two sub-channels, not one, acknowledges differences in over- or under-bite as exist in varying kinds and degrees of malocclusion. This provides for a greatly improved cleaning and stimulating action in the regions of these narrower teeth.

After a preliminary rotary sweep of the teeth and gum line, the brush head may be locked for more vigorous scrubbing of the chewing surfaces. Toward this end, the slidable grip element 12 may be slid up to the brushing head and locked into one of the recesses 16 to secure the head against rotation.

The brushing head may thereafter be used in the chewing mode, in which it is subjected to dental compression by the user biting down on the impact cushion 36. Because of the relatively nonresilient character of the displacement wafers 26, 27, the radial compression of the impact cushion 36 displaces the wafers axially and forces more of the central portions of the flange members 18, 19 into the cup-like recesses 45, 46. This in turn brings about an effective pivoting of the outer portions of the flange-forming members about the compression surfaces 47, 48, combined with a radially inward drawing motion. Accordingly, the divergently related walls 20, 21 of the flange-forming members are drawn inward to envelop the dental structure. The inward motion of the flange-forming members causes the bristles 34 and projections 33 to bear against the teeth and gums. This, combined with the chewing motion, results in an extremely effective massage of the gum areas, together with effective brushing action along the sides of the teeth, in the direction of the grain. In the region of the molars, the radially projecting bristles 40 are brought into probing compression with respect to the end surfaces of the teeth. In the area of the incisors and other narrower teeth, the chewing action is carried out in a manner to permit partial entry of the teeth into the interface area between the impact cushion and one or the other of the flange-forming members.

The device of the invention is far more effective than devices heretofore proposed. The described relationship of the soft, foam like flange-forming members, in conjunction with an impact cushion of similar material and in conjunction with the central displacement wafers, all maintained in a partially axially compressed condition by cup shaped retaining hubs, provides for a unique and effective squeezing-wiping motion of the flange-forming members when the impact cushion 36 is compressed between the teeth. In addition, the design provides for the equally effective massage and stimulation and cleaning of the incisors and other relatively narrower teeth, which are permitted to project into the inner face between the impact cushion and the flange-forming members.

Although the device of the invention is perhaps most useful in the chewing or compression mode, it readily adapts to a rotary mode for preliminary brushing purposes.

The design of the device of the invention, and its materials of construction, enable the device to be easily maintained in a clean and sanitary condition and thus be pleasant and attractive to use.

Notwithstanding its many and significant functional advantages, the device of the invention is of a relatively simplified construction, utilizing simple, readily available materials and techniques of manufacture, suitable for commercial level production and marketing on a reasonable cost basis.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. In a tooth brushing device of the type including a handle portion, and a brushing head mounted on said handle, the improvement in said brushing head characterized by (a) said head being in the form of a body of revolution and including soft, resilient inner and outer flange-forming members and a soft, resilient impact cushion located between said flange-forming members, (b) relatively non-resilient lens-like displacement wafers between said impact cushion and flange-forming members for effecting axially outward displacement of the flange-forming members upon radial compression of said impact cushion, and (c) annular restraining means positioned outside of said flange-forming members and engaging said members in annular areas spaced from the axis of the brushing head, (d) said displacement wafers and said annular restraining means being so related that, upon outward axial displacement of said wafers, central portions of said flange-forming members are displaced outward relative to said annular restraining means, causing a closing movement of portions of said flange-forming members radially outward of said restraining means.

2. A tooth brushing device according to claim 1, further characterized by (a) said restraining means comprising a pair of cup-like members secured in fixed axial separation and maintaining said flange-forming members in a state of initial compression, (b) said cup-like members forming opposed recesses for the reception of central portions of said flange-forming members, (c) said flange-forming members being normally only partially received in said recesses and being urged farther into said recesses upon radial compression of said impact cushion.

3. A tooth brushing device according to claim 2, further characterized by (a) said restraining members being of relatively non-resilient material and having an outer frusto-conical flange element supporting outer portions of said flange-forming members.

4. A tooth brushing device according to claim 1, further characterized by (a) said flange-forming members being formed of a soft sponge-like material, (b) opposing, inwardly facing surfaces of said flange-forming members mounting elements for contacting tooth and/or gum surfaces.

5. A tooth brushing device according to claim 4, further characterized by (a) resilient membrane means bonded to the inner surfaces of said flange-forming members, (b) radially outer portions of said membrane means having elements for contacting gum surfaces, (c) radially intermediate portions of said membrane means mounting bristle means for contact with dental surfaces.

6. A tooth brushing device according to claim 5, further characterized by (a) sleeve-like membrane means surrounding said impact cushion and mounting bristle means.

7. A tooth brushing device according to claim 5, further characterized by (a) said displacement wafers being bonded to said flange-forming members, said wafers and said impact cushion being relatively displaceable to accommodate entry therebetween of certain teeth.

8. A tooth brushing device according to claim 1, further characterized by (a) said brushing head being rotatably mounted on said handle, and (b) controllable locking means on one of said handle or brushing head for engagement with the other to selectively lock said brushing head against rotation.

9. In a tooth brushing device of the type including a handle portion, and a brushing head mounted on said handle, the improvement in said brushing head characterized by (a) said brushing head including soft, foam-like inner and outer flange-forming members and a soft, foam-like impact cushion located between said flange-forming members and mounted along an axis, (b) relatively non-resilient lens-like displacement members between said impact cushion and flange-forming members for effecting axially outward displacement of the flange-forming members upon radial compression of said impact cushion, and (c) restraining means positioned outside of said flange-forming members and engaging said members in contact areas spaced from said axis, (d) said displacement members and said contact areas being so related that, upon outward axial displacement of said displacement members, central portions of said flange-forming members are displaced outward relative to said contact areas, causing a closing-together movement of portions of said flange-forming members radially outward of said annular areas.

10. A tooth brushing device of claim 9, further characterized by (a) said flange-forming members having opposed surfaces for engagement with the teeth and gums upon said closing-together movement.

11. A tooth brushing device of claim 10, further characterized by (a) said brushing head being mounted for rotation on said handle, and (b) controllable means for selectively locking said brushing head against rotation.

12. A tooth brushing device of claim 10, further characterized by (a) bristle elements mounted on inwardly facing surface portions of said flange-forming members, (b) said bristle elements being arranged in a plurality of radially disposed lobe-like areas providing a scalloped outer edge configuration to the bristle area, and (c) there being an odd number of relatively uniform lobe-like areas of said bristles on each of said flange-like members.

13. A tooth brushing device of claim 12, further characterized by (a) said flange-like members each mounting a thin, resilient membrane element on its inner surface, and (b) said bristles being mounted on said membrane elements.

14. A tooth brushing device of claim 11, further characterized by (a) said impact cushion having a convex cross sectional contour, whereby said brushing head forms a recess of generally "W-shape" cross section.

15. A tooth brushing device according to claim 1, further characterized by (a) said flange-forming members supporting inwardly directed sets of teeth-engaging bristles in predetermined zones.

16. A tooth brushing device according to claim 15, further characterized by (a) said bristles being of progressively increasing length in radially outer portions of said zones.

17. A tooth brushing device according to claim 15, further characterized by (a) said zones being of smaller radial dimension than the typical exposed length of a tooth to be contacted thereby, whereby to limit the extent to which the gum line might be repulsed in chewing use.

* * * * *